US006555948B1

(12) United States Patent
Noll

(10) Patent No.: US 6,555,948 B1
(45) Date of Patent: Apr. 29, 2003

(54) ELECTRIC INCANDESCENT LAMP

(75) Inventor: Thomas Noll, Kipfenberg (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/396,284

(22) Filed: Sep. 15, 1999

(30) Foreign Application Priority Data

Sep. 24, 1998 (DE) ..... 198 43 852

(51) Int. Cl.[7] ..... H01K 1/02

(52) U.S. Cl. ..... 313/112; 313/113; 313/578; 313/278; 313/272

(58) Field of Search ..... 313/278, 272, 313/316, 115, 271, 315, 111, 112, 113, 578, 580, 238, 274

(56) References Cited

U.S. PATENT DOCUMENTS

| | | | | | |
|---|---|---|---|---|---|
| 3,558,958 | A | * | 1/1971 | Tatakoff et al. | 313/110 |
| 3,745,401 | A | * | 7/1973 | Stapleton et al. | 313/278 |
| 4,311,940 | A | * | 1/1982 | Fitzgerald et al. | 313/273 |
| 4,864,181 | A | * | 9/1989 | Huijbers et al. | 313/113 |
| 4,945,285 | A | * | 7/1990 | Gehret | 313/278 |
| 5,140,217 | A | * | 8/1992 | Rao et al. | 313/274 |
| 5,814,840 | A | * | 9/1998 | Woodall et al. | 257/103 |
| 5,815,254 | A | * | 9/1998 | Greene | 356/73 |
| 5,955,839 | A | * | 9/1999 | Jaffe et al. | 313/578 |
| 6,234,647 | B1 | * | 5/2001 | Liu | 362/235 |
| 6,259,193 | B1 | * | 7/2001 | Lipkin et al. | 313/341 |

FOREIGN PATENT DOCUMENTS

| | | | | |
|---|---|---|---|---|
| DE | 2640001 | * | 3/1977 | H01K/1/32 |
| EP | 0 588 541 A1 | | 3/1994 | H01K/1/32 |
| SU | 922915 | * | 4/1982 | H01K/1/16 |
| SU | 922915 | * | 5/1982 | |

* cited by examiner

*Primary Examiner*—Ashok Patel
(74) *Attorney, Agent, or Firm*—Robert F. Clark

(57) ABSTRACT

The invention relates to an electric incandescent lamp having a lamp vessel (12), at least one filament (14) which is arranged in the lamp vessel (12) and comprises at least a filament element (15) for generating radiation in the infrared region and in the visible region, and at least one filter (35), which is applied at least partially to the light vessel (12), reflects radiation in the infrared region and is transparent in the visible region, at least for selected wavelengths of radiation, at least one filament element (15) being of flat, in particular strip-shaped construction. It also relates to a method for producing such an electric incandescent lamp. FIG. 5.

23 Claims, 4 Drawing Sheets

ELECTRIC INCANDESCENT LAMP

TECHNICAL FIELD

The invention relates to an electric incandescent lamp, in particular an electric incandescent lamp having a lamp vessel, at least one filament which is arranged in the lamp vessel and comprises a filament element for generating radiation in the infrared region and in the visible region, and at least one filter, which is applied at least partially to the lamp vessel, reflects radiation in the infrared region and is transparent in the visible region, at least for selected wavelengths of radiation. Such an electric incandescent lamp is known from EP 0 588 541.

The invention further relates to a method for producing such an electric incandescent lamp.

The radiation emitted by an incandescent lamp is a function of three factors, specifically the filament temperature T, the spectral emittance $\epsilon$ of the radiating surface, and the area A of the radiating surface (Stefan-Boltzmann law). In the case of incandescent lamps, the two first mentioned factors are bounded below by the melting temperature and the temperature- and wavelength-dependent spectral emittance $\epsilon$ of the filament material. The radiating surface A of a helix is calculated in accordance with equation 1 as $$A=\pi\cdot D\cdot L \tag{1}$$

where D=wire diameter and L=effective wire length.

A typical value for A is circa 30 $mm^2$ for a 12 V/50 W halogen incandescent lamp.

A disadvantageous effect is exerted on the efficiency by losses which are determined essentially by the power (circa 62%) converted into IR radiation, and by the end losses (circa 10%) and the fill-gas losses (circa 10%). In order significantly to reduce IR losses, coatings (IRC=InfraRed Coating) which reflect IR radiation have been developed for the bulbs of incandescent lamps, such as are also mentioned, for example, in EP 0 588 541. It is important in this regard that the arrangement of incandescent helix and coating reflecting IR radiation must be such that the reflected IR radiation is focussed onto the incandescent helix. The cause of an unfocussed reflection can, for example, be that the filament axis does not run parallel to the bulb axis, and the helix sag occurring over the lifetime of an incandescent lamp. In particular since the layer reflecting IR radiation is usually attached to the outside of the bulb, it is to be borne in mind in the case of ellipsoid bulbs that the outer contour of the bulb can deviate from the desired geometry. It is also to be taken into consideration that the probability of absorption decreases strongly in the case of multiple reflections.

The already mentioned EP 0 588 541 has therefore addressed the object of proposing an electric incandescent lamp in which the helix and the layer reflecting IR radiation are arranged relative to one another in an essentially unfocussed relationship, and yet satisfactory absorption of IR radiation is ensured. In order to achieve this object, EP 0 588 541 provides an incandescent filament which comprises coiled segments of tungsten wire which are connected to one another and are supported by segment bearings in between the segments in an essentially rectangular frame.

A disadvantage of this solution is, on the one hand, that the segments made from coiled tungsten wire cannot be packed tightly enough in order to ensure a high probability that the IR radiation is already led back to the incandescent filament after at most two reflections, since at a high packing density there is a risk of short circuits between individual coiled wire segments, for example owing to increases in size or vibrations. It is also to be considered that an arc can be formed, and that the helixes can break off at the connecting points to the bearing frame. A substantial disadvantage exists, in particular, in that the coiling of the tungsten wire leads to a so-called "radiation blackening". To be specific, because of the temperature-dependence of its spectral emission coefficient, pure tungsten, which is preferably applied as filament material, has a light yield which is higher at the same temperature by circa 40% than the black body. This gain in selectivity is lost in part upon coiling the wire.

It would be possible to counter a reduction in the radiation blackening by enlarging the pitch. However, this would contradict the requirement for compact filaments.

Furthermore, there is a disadvantage with the incandescent lamp according to the prior art of EP 0 588 541 in that only materials which permit coiling with regard to their brittleness come into consideration for the incandescent helixes.

SUMMARY OF THE INVENTION

It is therefore the object of the present invention to propose an incandescent lamp which permits the construction of compact filaments in conjunction with minimum radiation blackening. In addition, it is to reduce the risks of helix short circuits, the breaking off of the helix at its point of suspension and the formation of arcs, and to permit a high degree of absorption of IR radiation by the filament. Furthermore, it is to permit, for the filaments, the use of materials which are not suitable for coiling because of their material properties.

This object is achieved by providing the electric incandescent lamp of the generic type with a filament element which is of flat, in particular strip-shaped construction.

It is also an object of the present invention to propose a method for producing such an electric incandescent lamp. This object is achieved by means of a method having the steps in accordance with claim 31.

The production of the helix is completely eliminated by the flat construction of the filament element. The outlay on adjustment turns out to be exceptionally slight owing to the inherent adjustment of a filament, formed from one or more flat filament elements, with reference to the layer reflecting IR radiation. Particularly in the case of the production of elliptical bulbs, the requirements placed on the geometry of the bulb can be kept slight, as a result of which there is an appreciable reduction in the outlay on production here, as well. There is necessarily a substantial reduction in the rejection proportion owing to the inherent adjustment.

The flat filament element used in accordance with the invention has a substantially higher light yield at the same temperature than a coiled filament, since the radiation blackening mentioned at the beginning does not occur in the case of uncoiled flat filament elements.

In the case of the use of a single flat filament element to construct the filament, it is necessarily impossible for gaps to arise between individual segments, as a result of which it is possible to ensure given an appropriately wide construction of the filament element in relation to the inside diameter of the lamp vessel that IR radiation impinges again on the filament element after at most two reflections at the layer reflecting IR radiation.

Because of the design, winding short circuits and the formation of arcs as well as the breaking off of the helix at the point of suspension does not occur.

In the preferred embodiment mentioned, the filament element is constructed in one layer, for example from tungsten. In order to promote the emission in an envisaged direction, it is possible for there to be situated opposite the surface of the filament element situated opposite this direction a layer for reflecting radiation at least in the visible region, for example a reflecting layer.

The thickness of the filament element is preferably circa 5 to 50 $\mu$m. The slight filament cross section resulting therefrom leads to a low heat dissipation, and therefore additionally reduces the end losses. Given a foil thickness of 10 $\mu$m, there is, for example, an increase in the surface of the 50 W helix mentioned at the beginning to 270 $mm^2$, that is to say by a factor of 8.5.

In further preferred embodiments, the filament element is constructed in a plurality of layers. This permits the use for the radiating layer of materials which, for example owing to their brittleness, would not come into consideration for producing helixes. In particular, it is possible to make use here of materials with a higher emission coefficient than tungsten for constructing the radiating layer arranged on a base layer. It is possible, as a result, to realize layer thicknesses in the $\mu$m range which are required to avoid absorption losses in the case of transparent radiating layers. By treating the surface or by using special coating techniques, for example nano-technology, it is possible to increase the surface of the radiating layer by a multiple with respect to the surface of the base layer.

In the case of multi-layer construction of the filament element, the base layer or an additional layer applied to the rear side of the base layer can be produced from a material which has a lower emission coefficient for radiation in the infrared and/or visible regions than the radiating layer. If light is to exit from the incandescent lamp only in a specific direction, it is possible to arrange a layer for reflecting radiation at least in the visible region, in particular a reflecting layer, opposite the base layer or the additional layer. Owing to the splitting up into a base layer, which can be multi-layered, in turn, and a radiating layer, it is possible to produce the material for the base layer, independently of its emission coefficient, from a material which is optimum for producing films and conducting current and, on the other hand, to tune the light-emitting radiating layer to the special requirements of high emission or high absorption in a specific fashion. Since the filament element does not have to be coiled, there is even the possibility of using materials other than metallic ones which have a high selectivity and high emission in the visible spectral region such as, for example, special ceramics.

The filament can be composed of a plurality of filament elements which can, for example, be arranged next to one another or offset in height. In the latter case, it is particularly advantageous to select the width of the filament elements so as to produce overlapping.

Both an individual filament element and a plurality of filament elements can be dimensioned with regard to their overall width such that the latter is 25–100% of the inside diameter of the lamp vessel.

By interconnecting a plurality of filament elements, it is possible to achieve overall areas which permit the temperature of the filament elements to be lowered to values of circa 2000 K. This leads to a sharp reduction in the rate of evaporation, and thus to an improvement in length of lifetime. The red shift connected with the temperature drop can be compensated by a blue filter expediently fitted on the luminaire side.

Because of the high light yield, it is possible to operate using solar cells, storage batteries etc. Lighting engineering which protects the environment thereby becomes possible in areas which are not connected to the electric supply mains.

Owing to the fact that the filament is connected in a lamp vessel to a clamping device, for example a spring, which holds the filament or the filament elements clamped, sagging of the flat filament elements, for example through ageing or as a function of the spatial assembly of the lamp, is avoided. The current path in the lamp body correspondingly comprises a section which is of variable length and is preferably arranged parallel to the clamping device and can, for example, comprise a plurality of folded molybdenum strips arranged in parallel.

It has proved to be particularly advantageous to construct the layer reflecting IR radiation in the form of a plurality of filters which are arranged one behind another in the direction of propagation of radiation and are tuned to one another with respect to their wavelength-dependent reflection factors so as to produce a high total reflection factor for radiation in the infrared region. Mixed metallic and dielectric systems are preferably used for the coating.

Owing to the fact that a foil section, for example made from molybdenum foil, is provided in the current path in the region of a pinch of the lamp vessel, heating there by IR radiation is eliminated. The connections are therefore colder than in the case of known embodiments, and this leads to a further reduction in the end losses.

Depending on the application, the lamp vessel can be evacuated or filled with a fill-gas, the fill-gas advantageously containing at least one halogen.

Different variants come into consideration with regard to the arrangement of filament and lamp vessel: firstly, filament and lamp vessel can be of flat construction and arranged parallel to one another; however, they can also be of concentric construction. For example, the lamp vessel can be arranged concentrically around the filament. It is then particularly advantageous if the filament is arranged concentrically around a layer for reflecting radiation at least in the visible region, in particular a reflecting layer. The lamp vessel can in this case have a round, elliptical or rectangular cross section.

Further advantageous developments of the invention are defined in the subclaims.

BRIEF DESCRIPTION OF THE DRAWINGS

Exemplary embodiments are described below in more detail with reference to the attached drawings, in which.

DETAILED DESCRIPTION OF THE INVENTION

Figure 1:
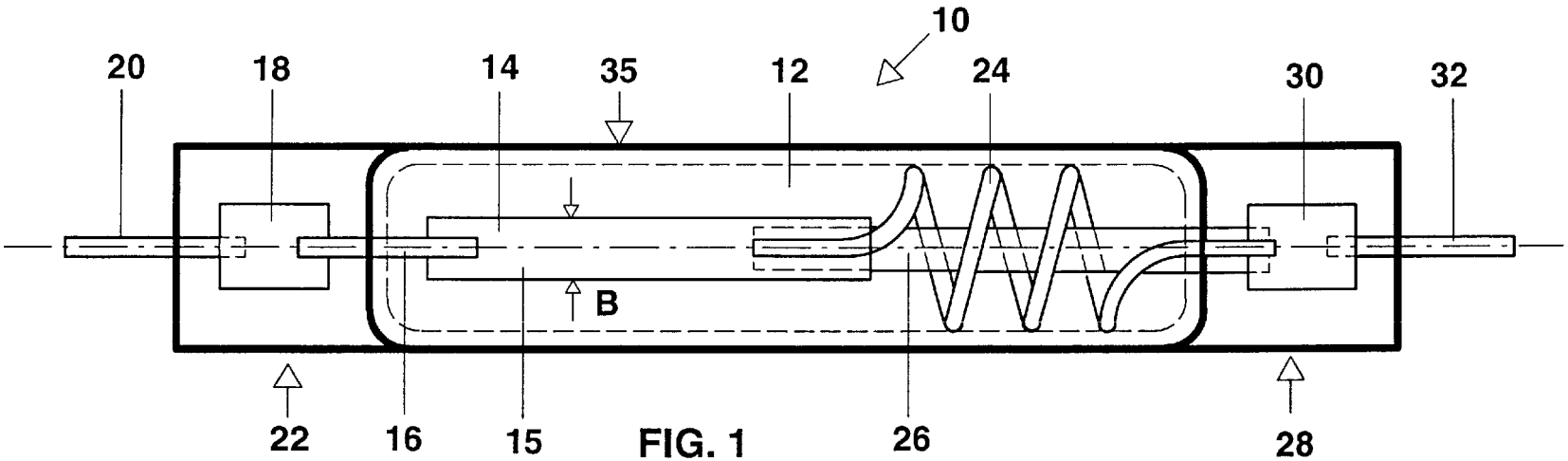
FIG. 1 shows a top view of an incandescent lamp according to the invention, in accordance with a first embodiment.
Figure 2:
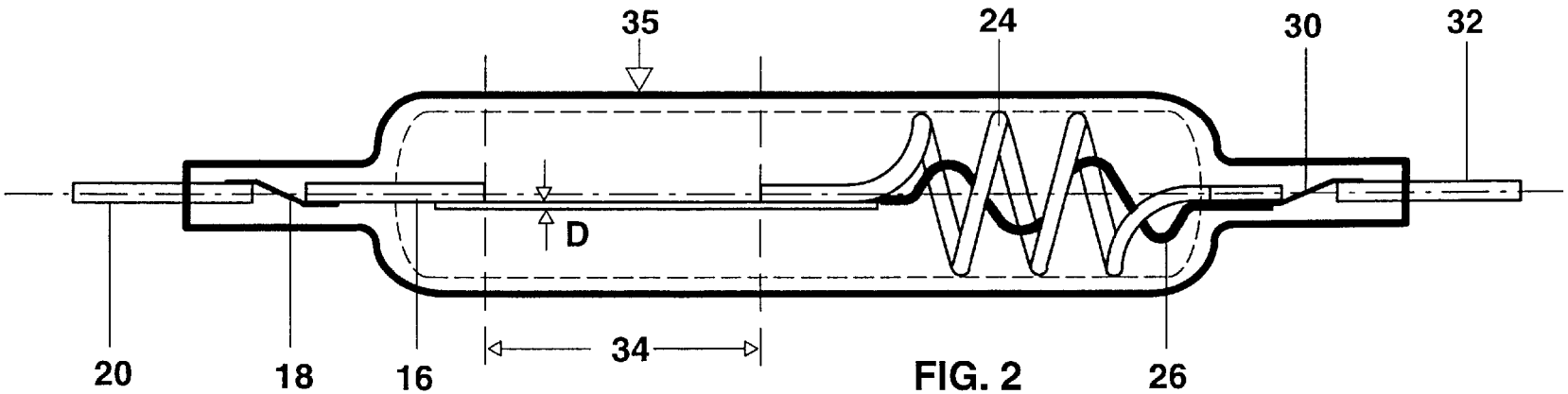
FIG. 2 shows a side view of the incandescent lamp of FIG. 1.

FIGS. 1 and 2 show an incandescent lamp 10 according to the invention, in which a filament 14 having an individual filament element 15 is arranged in a bulb-shaped lamp vessel 12. The bulb 12 preferably consists of silica glass or hard glass. The selection of material for the filament element 15 depends, in particular, on whether a single-layer or multi-layer design is selected. In the case of a single-layer design, consideration as material for the filament element 15 is given, in particular, to tungsten, but also, for example, to the carbides of tungsten and molybdenum. In the case of a multi-layer design, a base layer is connected to a radiating layer. Whereas the base layer can be a metal strip, for example, use may be made as radiating layer of transparent selective radiators or metallically reflecting selective radiators. Of the transparent selective radiators, SiC is to be particularly emphasized, while the carbides of tungsten and molybdenum, for example, come into consideration for the metallically reflecting selective radiators. In the case of a multi-layer design, it is possible, if the purpose of the application requires it, for a radiating layer also to be applied on both sides of the base layer. Known deposition techniques, but in particular the sol-gel method and dip-coating come into consideration for applying layers to a base layer.

The filament element 15 is currently of strip-shaped construction and has a thickness D of preferably 5 to 50 $\mu$m, the thickness of the radiating layer preferably being in the range of 1–5 $\mu$m in the case of a multi-layer design. When use is made of a single filament element 15, its width B can be up to 100% of the bulb inside diameter, preference being given to embodiments having a ratio of 0.8 to 0.9 of the width of the filament element to the bulb inside diameter. One side of the filament element 15 is welded to a molybdenum pin 16 which is connected, in turn, to a molybdenum foil 18. The molybdenum foil 18 is connected, for its part, to a pin-shaped molybdenum supply lead 20 which projects from the lamp vessel 12. In the region of the pinch point 22, the molybdenum foil ensures a reliable sealing of the bulb interior from the environment. The other side of the filament element 15 is connected, on the one hand, to a spring 24 and, on the other hand, to four folded molybdenum strips 26. The spring 24 ensures that the filament element 15 remains clamped independently of external influences, for example temperature fluctuations, ageing, orientation when the lamp 10 is mounted in space, etc. Constructing the spring 24 of tungsten ensures that the main component of the current is fed to the filament element 15 via the molybdenum strips 26. If the main current component were to flow via the spring 24, the latter would be fully annealed and thereby lose its spring properties. Instead of molybdenum strips 26, strips made from other suitable materials come into consideration. Their variability with respect to length is ensured by constructing them to form folded strips. Other possibilities for clamping devices, or the realization of components of the current path of variable length are obvious to the person skilled in the art. A preferred possibility for connecting the spring 24 and the molybdenum strips 26 to the filament element 15 is welding. The molybdenum strips 26 are connected for their part to a pin-shaped supply lead 32 in the region of the pinch point 28 via a molybdenum foil 30. The advantages of the molybdenum foil 18 hold also for the molybdenum foil 30.

The bulb 12 is provided in the region 34 with a filter 35 in the form of a coating reflecting IR radiation. This filter 35 is transparent at least for selected wavelengths from the region of visible light. Examples of such coatings can be taken from EP 0 588 541. The interior of the bulb 12 can be evacuated, but can also be filled with a fill-gas, preferably containing a halogen.

Figure 3:
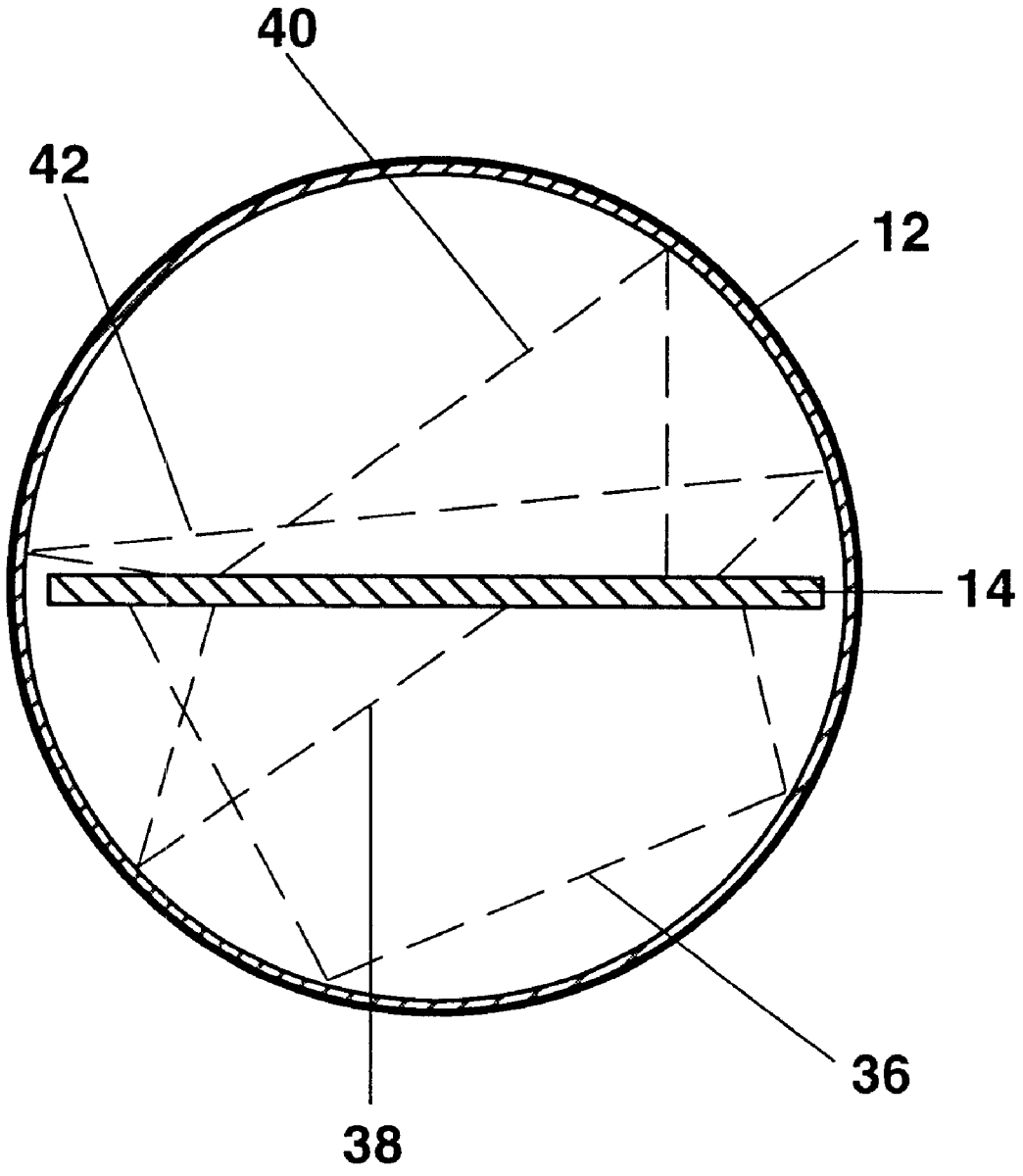
FIG. 3 shows a cross section through an incandescent lamp according to the invention.

FIG. 3 shows a cross section through an incandescent lamp according to the invention. In the exemplary embodiment shown there, the ratio of the width of the filament element 15 to the inside diameter of the bulb 12 is above 90%. Also illustrated are exemplary courses 36, 38, 40, 42 of IR radiation. As emerges plainly herefrom, it is possible to ensure by suitable selection of the ratio of the width of the filament elements to the bulb inside diameter that the IR radiation impinges on the filament element 15 again after at most two reflections.

In order to produce such an incandescent lamp, the first step is to connect to two electrically conductive connecting elements at least one filament comprising at least one flat, in particular strip-shaped filament element, it being possible to generate radiation in the infrared region and in the visible region with the aid of the filament element. This combination is arranged in a lamp vessel 12, which is subsequently sealed in a gas-tight fashion, the connecting elements projecting from the lamp vessel. Subsequently, at least in the region 34 of the lamp vessel the coating 35 is applied which reflects radiation in the infrared region and is transparent at least to selected wavelengths of radiation in the visible region.

A clamping device 24, which is possibly to be provided, is preferably likewise connected by welding to the filament element 15 before the combination is arranged in the lamp vessel 12.

Figure 4:
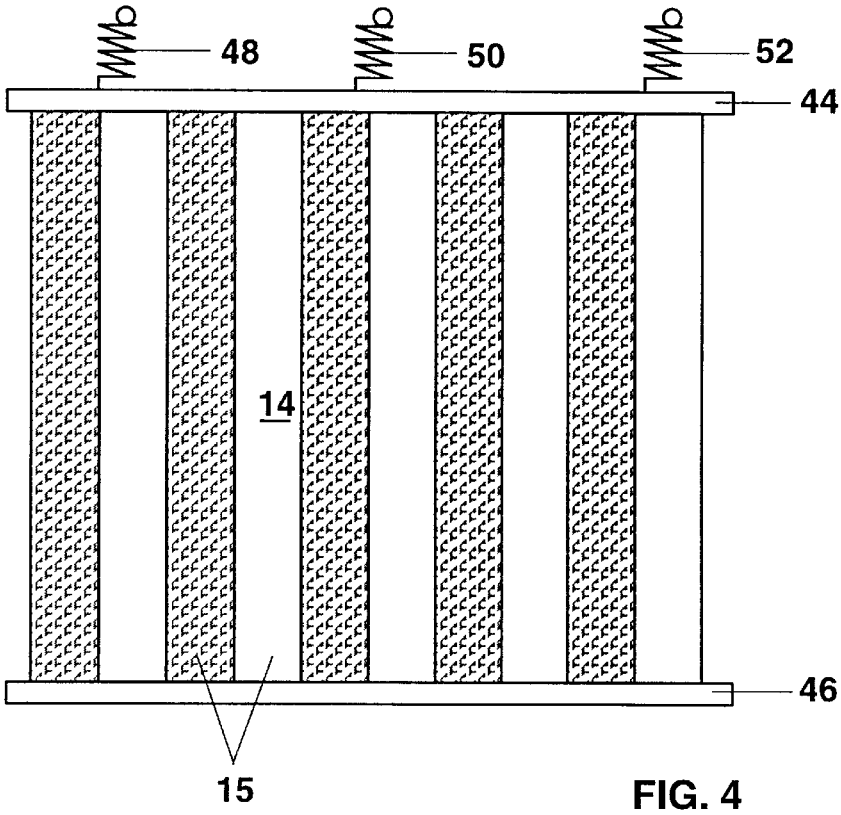
FIG. 4 shows a top view of an incandescent lamp according to the invention, in accordance with a second embodiment.
Figure 5:
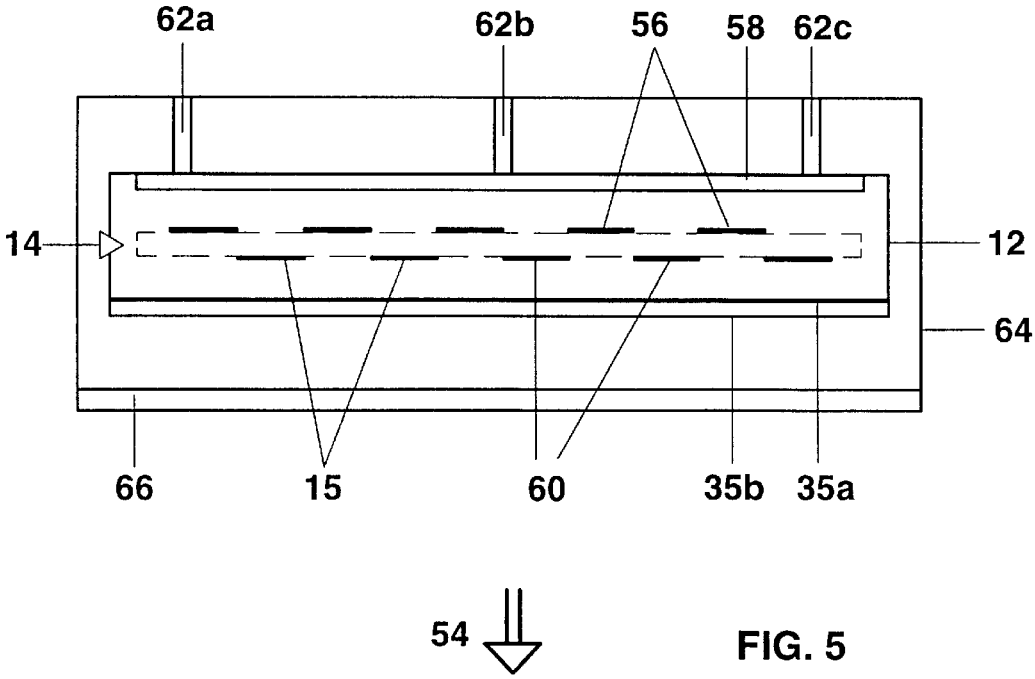
FIG. 5 shows a cross section through the incandescent lamp in accordance with FIG. 4.

FIGS. 4 and 5 show a diagrammatic top view and cross-sectional view, respectively, of a further embodiment of an incandescent lamp according to the invention. The filament 14 is formed in this exemplary embodiment from ten filament elements 15 which are arranged alternately at two height levels. The filament elements 15 are constructed with respect to their width such that the gaps between two neighbouring filament elements located at the other height are covered. The filament elements are clamped in two clamping rails 44, 46, three clamping springs 48, 50, 52 being provided in order to hold the filament elements 15 above the clamping rails in the clamped state. The filament elements 15 can be of single-layer or multi-layer design. Light can be emitted into a half space using the design represented in FIG. 5. The arrow 54 shows the direction of emission. The rear side 56 of the filament element 15 is situated opposite a highly polished mirror 58 which serves the purpose of reflecting radiation both in the infrared region and in the visible region. In a particularly favourable way, furthermore, the rear side 56 of the filament elements 15 is formed by a material which has an emission coefficient as low as possible in the entire spectral region and as high a degree of absorption as possible, in particular in the infrared region of radiation. It is particularly advantageous if the emissive response of the rear side 56 of the filament elements 15 is tuned to the reflectivity of the mirror situated opposite, that is to say the mirror 58 is to exhibit in the spectral region a reflective response which is as good as possible by virtue of the fact that the rear side 56 of the filament elements 15 emits to a high degree.

In the case of a multi-layer design of the filament elements 15, the front side 60 of the filament elements 15 can be formed by a layer which exhibits an emissive response which is as good as possible in the visible region. For the purpose of reflecting the component, emitted by the front side 60, in the infrared region, the lamp vessel 12 is provided on the side which is situated opposite the front side of the filament elements 15 with a filter 35 which is composed of a plurality of layers. In this case, a layer 35*a* is applied to the inside of the lamp vessel 12, while a second layer 35*b* is applied to the outside of the lamp vessel 12. The two layers 35*a*, 35*b* can be tuned to one another so as to produce overall as high as possible a reflection factor for radiation in the infrared region.

The lamp vessel 12 is fastened via three fastening elements 62*a*, 62*b*, 62*c* in a luminaire housing 64 which also serves to dissipate heat. It is possible for a colour filter 66, in particular a blue filter, to be applied to the luminaire housing 64. The blue filter serves, in particular, to compensate the red shift associated with the temperature drop which becomes possible due to the incandescent lamp according to the invention.

A high degree of absorption is achieved by the overlapping of the individual filament elements 15. Alternatively, in the case of a lesser degree of absorption the filament elements can be arranged at a specific spacing next to one another, that is to say at one height.

Figure 6:
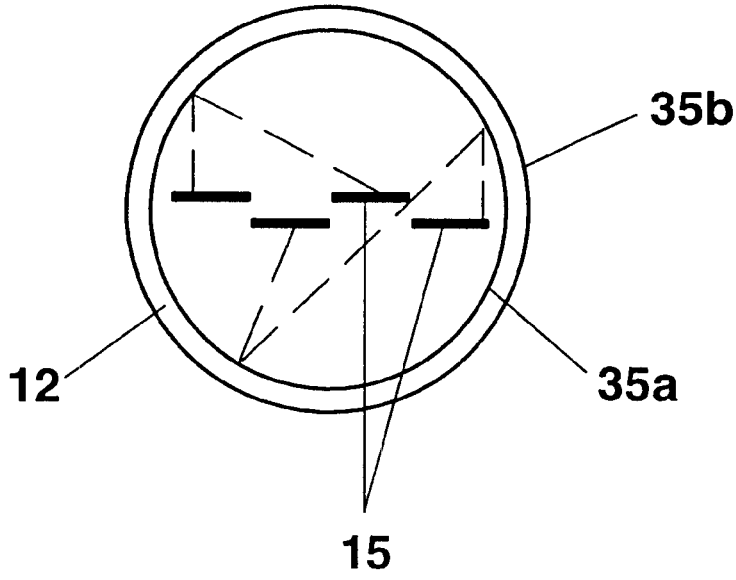
FIG. 6 shows a cross section through an incandescent lamp according to the invention, in accordance with a third embodiment.

FIG. 6 shows a further embodiment, in which the four filament elements 15 are arranged offset in height in a lamp vessel having a circular cross section. The filters 35*a* and 35*b* are applied to the inside and outside, respectively, of the lamp vessel 12. It is also possible to achieve here due to the overall width of the filament elements 15, which form the filament 14, in relation to the inside diameter of the lamp vessel 12 that IR radiation emitted by the filament elements 15 impinges on the filament elements 15 again after at most two reflections.

Figure 7:
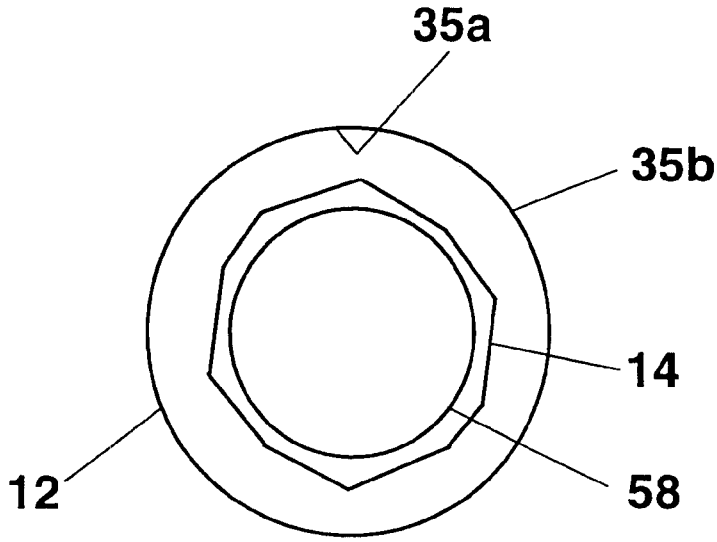
FIG. 7 shows a cross section through an incandescent lamp according to the invention, in accordance with a fourth embodiment.

As an example of a coaxial design of the incandescent lamp, FIG. 7 shows a cross section through an embodiment in which the filament 14 is arranged concentrically about a reflecting layer, in particular mirror layer 58. The lamp vessel 12 is coated on its inside and its outside with filters 35*a* and 35*b*, respectively. The embodiments represented in FIGS. 6 and 7 offer the advantage of a simpler vacuum seal, a better resistance to pressure and vacuum on the part of the lamp vessel 12, the possibility of using available raw materials, for example tubes and holders, as well as the possibility of use in existing luminaires.

When use is made of a plurality of filters 35, heating up of the lamp vessel 12 can be effectively prevented by applying an FIR (Far-Infra-Red) filter on the filament side. The result is to lengthen both the lifetime of the filter and the lamp performance while, in addition, it becomes possible to make use, as filter substrate, of glasses which are more cost effective, because they are thermally less demanding.

In accordance with embodiments which are not represented, the cross section of the lamp vessel in which the filament 14 is accommodated can also be elliptical or rectangular. The lamp vessel can be elongated or U-shaped, but also spherical and can have one or more pinch points. When use is made of a plurality of filament elements, the latter can be connected both serially and in parallel. In particular, given suitable dimensions, the serial connection can be operated on system voltage, resulting in the elimination of ballasts.

What is claimed is:

1. Electric incandescent lamp comprising: a lamp vessel (12), at least one filament (14) which is arranged in the lamp vessel (12) and comprises at least one flat, strip-shaped filament element (15) for generating radiation in the infrared region and in the visible region, at least one filter (35, 35*a*, 35*b*) which is applied at least partially to the lamp vessel (12) and reflects radiation in the infrared region and is transparent to radiation in the visible region at least for selected wavelengths the filament (14) being connected to a clamping device (24) which holds the filament (14) clamped, a current path in the lamp, vessel (12) comprising at least one section (26) of variable length being connected to the filament (14).

2. Incandescent lamp according to claim 1, characterized in that the filament element (15) has a front side (60) and a rear side (56), and the lamp vessel has a layer (58) for reflecting radiation at least in the visible region situated opposite the rear side.

3. Incandescent lamp according to claim 1, characterized in that the thickness of the filament element (15) is in a range from 5 to 50 $\mu$m.

4. Incandescent lamp according to claim 1, characterized in that the filament element (15) comprises a base layer and at least one radiating layer for generating radiation in the infrared region and visible region.

5. Incandescent lamp according to claim 4, characterized in that the filament element (15) has a front side (60) and a rear side (56), and the front side is formed by the radiating layer and the rear side is formed by the base layer or an additional layer, the base layer or the additional layer having a lower emission coefficient for radiation in the infrared and/or visible region than the radiating layer.

6. Incandescent lamp according to claim 5, characterized in that a layer (58) for reflecting radiation at least in the visible region is situated opposite the base layer or the additional layer.

7. Incandescent lamp according to one of claim 4, characterized in that the radiating layer has a thickness of less than 50 $\mu$m.

8. Incandescent lamp according to claim 4 characterized in that the radiating layer has a thickness of less than 10 $\mu$m.

9. Incandescent lamp according to claim 4 characterized in that the radiating layer comprises silicon carbide, tungsten carbide or molybdenum carbide.

10. Incandescent lamp according to claim 1, characterized in that the filament (14) comprises a plurality of filament elements (15) arranged next to one another.

11. Incandescent lamp according to claim 1, characterized in that the filament (14) comprises a plurality of filament elements (15) arranged with offset heights.

12. Incandescent lamp according to claim 11, characterized in that the odd-numbered filament elements (15) are arranged at a first height and the even-numbered filament elements (15) are arranged at a second height, the spacing between two neighbouring even and two neighbouring odd-numbered filament elements (15) being smaller than the width of the odd or even-numbered filament element (15) arranged therebetween.

13. Incandescent lamp according to claim 1, characterized in that the width of the filament (14) is 25 to 100% of the inside diameter of the lamp vessel (12).

14. Incandescent lamp according to claim 1, characterized in that the clamping device comprises at least one spring (24).

15. Incandescent lamp according to claim 1, characterized in that the section (26) of variable length is arranged in parallel to the clamping device (24).

16. Incandescent lamp according to claim 1, characterized in that it has a plurality of filters (35*a*, 35*b*) which are arranged one behind another in the direction of propagation of radiation and whose wavelength-dependent reflection factors are mutually tuned to achieve a high total reflection factor for radiation in the infrared region.

17. Incandescent lamp according to claim 1, characterized in that the section of variable length comprises a plurality of folded molybdenum strips (26) arranged in parallel.

18. Incandescent lamp according to claim 1, characterized in that the lamp vessel (12) is arranged concentrically around the filament (14).

19. Incandescent lamp according to claim 18, characterized in that the filament (14) is arranged concentrically around a layer (58) for reflecting radiation at least in the visible region.

20. Incandescent lamp according to claim 1, characterized in that the lamp vessel (12) has a round, elliptical or rectangular cross section.

21. Incandescent lamp according to claim 1, characterized in that the filament (14), lamp vessel (12) and filters (35; 35*a*, 35*b*) are dimensioned and arranged such that radiation in the visible region exits from the lamp vessel (12) only in a half space or a small section of space.

22. Incandescent lamp according to claim 1 characterized in that the filament element is a single layer comprised of tungsten, tungsten carbide, or molybdenum carbide.

23. Incandescent lamp according to claim 1 characterized in that the filament element(s) are operated at a temperature of about 2000 K and the lamp vessel has a blue filter.

* * * * *